United States Patent [19]

Foreman

[11] Patent Number: 4,811,956

[45] **Date of Patent: * Mar. 14, 1989**

[54] HOLDER FOR TARGET PATTERN PAPER

[76] Inventor: Howard R. Foreman, Rte. 1, Box 110A, Miami, Okla. 74354

[ * ] Notice: The portion of the term of this patent subsequent to Jan. 20, 2004 has been disclaimed.

[21] Appl. No.: 934,030

[22] Filed: Nov. 24, 1986

Related U.S. Application Data

[63] Continuation-in-part of Ser. No. 759,332, Jul. 26, 1985, Pat. No. 4,637,615.

[51] Int. Cl.[4] ..... F41J 1/10; F41J 1/00; F16D 1/00

[52] U.S. Cl. ..... 273/407; 273/409; 403/170

[58] Field of Search ..... 403/169, 170, 173, 397, 403/174; 273/398–402, 407, 408, 403, 404; 40/610; 248/541

[56] References Cited

U.S. PATENT DOCUMENTS

| | | | |
|---|---|---|---|
| 937,733 | 10/1909 | Worrell | 273/404 |
| 1,092,217 | 4/1914 | Hopkins | 403/173 |
| 1,203,937 | 11/1916 | Surface | 248/541 |
| 1,208,235 | 12/1916 | Thayer | 273/400 |
| 1,364,010 | 12/1920 | Tyerman | 273/407 |
| 1,382,324 | 6/1921 | Siefer | 403/174 |
| 1,571,581 | 2/1926 | Fliegelman et al. | 248/541 |
| 2,200,179 | 5/1940 | Kruger | 403/174 |
| 2,538,118 | 1/1951 | Miller | 273/407 |
| 3,036,705 | 5/1962 | Haecker | 273/408 |
| 3,087,701 | 4/1963 | Wallace | 273/407 |
| 3,164,384 | 1/1965 | Stewart | 273/403 |
| 3,601,353 | 8/1971 | Dale | 273/407 |
| 3,972,638 | 8/1976 | Vivoli | 403/174 |
| 4,323,251 | 4/1982 | Loveland et al. | 273/407 |
| 4,417,728 | 11/1983 | Hay et al. | 273/407 |
| 4,637,615 | 1/1987 | Foreman | 273/407 |

FOREIGN PATENT DOCUMENTS

| | | | |
|---|---|---|---|
| 197892 | 8/1938 | Switzerland | 273/407 |

OTHER PUBLICATIONS

1977 Bear Archery Catalog.

*Primary Examiner*—Richard C. Pinkham
*Assistant Examiner*—Mark S. Graham
*Attorney, Agent, or Firm*—Head & Johnson

[57] ABSTRACT

This is a holder for shotgun pattern paper. The shot pattern of a shotgun is most important to a hunter. This invention provides a way to determine that pattern for any shotgun. A three-part circular or four-part square holder is supported above the ground by two spaced apart support members. The parts are held together by unique clamp. Clips are provided about the periphery of the square or circular ring for holding paper or a cardboard target base with the target printed thereon. A shotgun or rifle is then fired at the target from the selected distance and the pattern of the shot or accuracy of the rifle can be seen on the paper or target base.

6 Claims, 8 Drawing Sheets

HOLDER FOR TARGET PATTERN PAPER

RELATED APPLICATIONS

This application is a continuation-in-part of my application Ser. No. 759,332, filed July 26, 1985 now U.S. Pat. No. 4,637,615. and entitled "HOLDER FOR SHOTGUN PATTERN PAPER".

BACKGROUND OF THE INVENTION

This relates to an apparatus for determining the shot pattern of a shotgun or accuracy of a rifle or other gun shooting bullets. The pattern which the shots of a shotgun make is most important to a hunter. The pattern for a particular shotgun can mean the difference between either hitting or missing the target. It is important to know the shot pattern for the particular shot and load to be used by the hunter for a particular gun. It is of course necessary to properly calibrate a rifle for accurate shooting.

SUMMARY OF THE INVENTION

This invention is for a holder for a target base for pattern paper for a target base for shotgun or rifle. It includes a circular ring in three pieces or a square member in four pieces and two end support members for either the ring or square. The device can be taken apart and can be stored in a compact arrangement taking very little room.

In one embodiment, the holder includes a ring of two upper and one lower sections or loops each in the form of arcs of less than 180°. Each upper loop has an upper end and a lower end, and the lower loop has a hook at each end. Clamp means are provided to connect the two upper portions together. Special clamp means are provided to clamp each end of the lower section to the unclamped end of the upper two sections. These lower special clamping means are also provided with means for receiving two bars or support legs which extend outwardly from the ring to form a support from the ground in the shape of an isosceles triangle. These special lower clamps will be described later and are such that they hold the support legs and the ring rigidly together.

There are paper clipping or hooking means secured to the assembled ring onto which the target or pattern sheet may be hung. After the target paper has been hung, a shotgun is fired at the target from a selected distance and the holes in the paper form the shot pattern for that shotgun for the shot used. A rifle may be fired at the target for calibration.

Instead of the ring I can use another embodiment featuring a square paper holder. This includes a top, two sides and a bottom member, support legs and clamps connecting the parts together.

In a still further embodiment especially useful for rifle shooting I use a target base section made of a relatively stiff material and foldable along folding lines into a compact form. The target base has a critical target area where most of the rifle shots will strike. When the target area gets too many holes in it I merely place a target section of identical configuration to said critical area over the shot-up critical area.

It is thus an object of my invention to provide a portable holder for shotgun pattern paper or a target base which is easy to assemble.

Various objects and a better understanding of the invention can be had from the following description taken on conjunction with the drawings.

DETAILED DESCRIPTION OF THE PREFERRED EMBODIMENT

Figure 2:
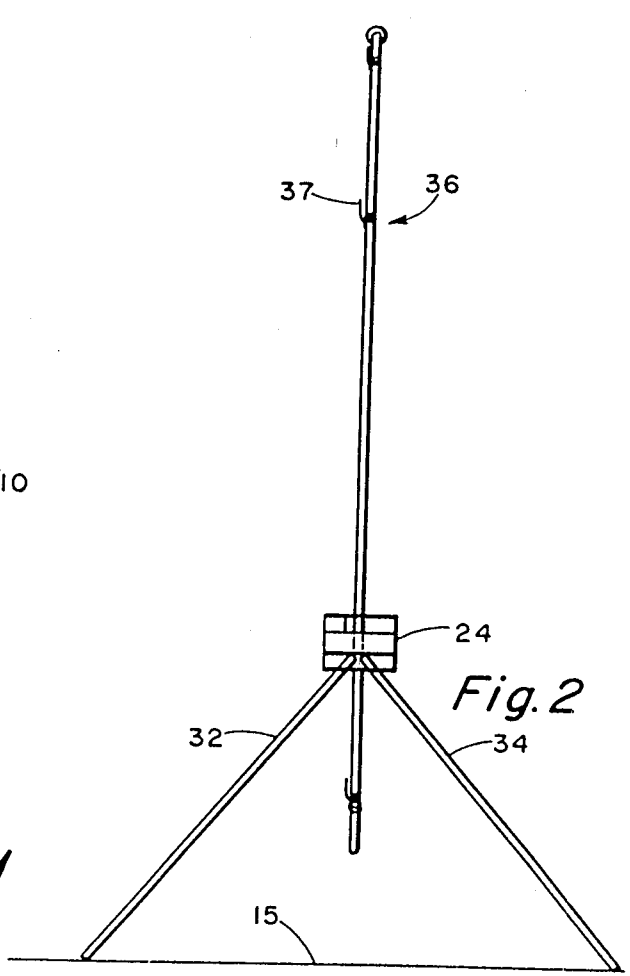
FIG. 2 is an end view of the holder of FIG. 1.
Figure 1:
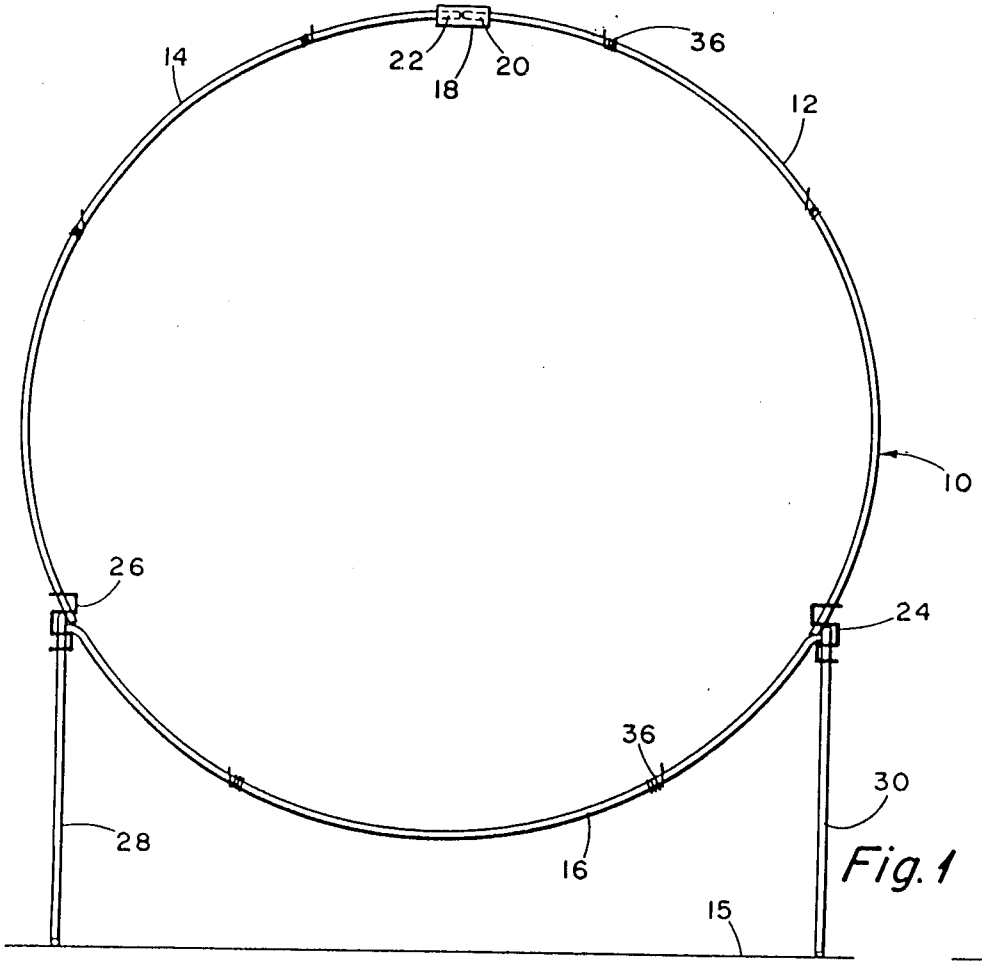
FIG. 1 shows a front view of my assembled holder for shotgun pattern paper.

Attention is first directed to FIGS. 1 and 2 which shows a portable pattern holder which includes a ring 10 which includes two upper loops 12 and 14 and a lower loop 16, each in the form of arcs preferably of less than 180° each. These loops can be small diameter rods such as 5/16" diameter and can be made from suitable material such as steel. The ends of loops 12 and 14 are merely a part of the arc i.e., they need not be bent. The upper ends of loops 12 and 14 are connected by a tubular clamp means 18 into which each end 20 and 22 of the upper loops can be inserted. The clamp is made to have friction fit with ends so that the loops will be maintained therein once they are forced in but the friction is small enough that they can be removed easily by hand. The lower end of loops 12 and 14 and both ends of the lower loop 16 are connected by a clamp means 24 and 26. If desired the lower ends of loops 12 and 14 may be welded to clamps 24 and 26 respectively. There is a left support means 28 and a right support means 30. Each of the support means comprise a first leg 32 and a second leg 34 as shown in FIG. 2. The configuration of the preferred form of clips 26 and 54 will be described in relation to FIGS. 4 and 5. Also shown in FIGS. 1 and 2 are pattern holding hooks or clips 36. There are shown six such clips in FIG. 1, although any practical number can be used. The clips are more clearly shown in FIG. 2 and can be attached to the loops in any desirable manner such as by welding or rigidly wrapping stiff heavy wire around the loops and having an upper prong 37.

Figure 3:
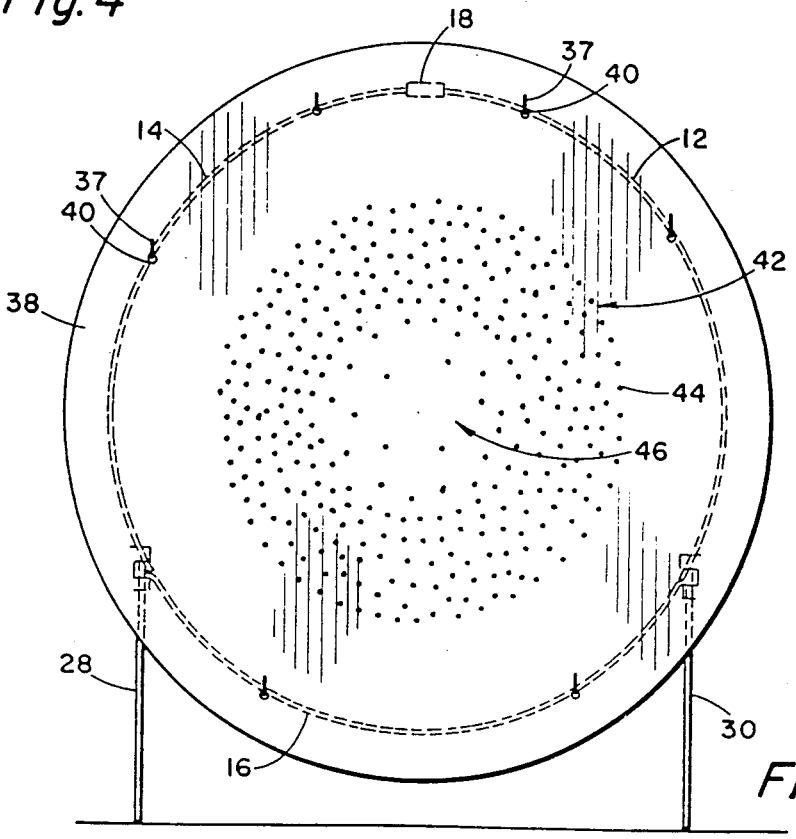
FIG. 3 illustrates the holder of FIG. 1 with pattern paper mounted thereon and shot pattern indicated.

Attention is next directed to FIG. 3 which shows pattern paper 38 which has a plurality of holes 40 which are arranged in the same pattern as are the hooks 36 shown in FIG. 1. Each projection 37 is inserted through its associated hole 40 and the paper is then placed in the position shown in Figure 3. There is shown a shot pattern 42 comprising a plurality of individual shot holes 44. The arrangement of these holes show clearly that there is a void area 46 of shot holes in the center of the pattern. This would indicate to the shotgun owner that any target in the void area 46 might be missed by a shot with this pattern even though the aim for the target was perfect. Depending on the size of the target, it might be missed all together or it might have only very few shots therein.

Figure 4:
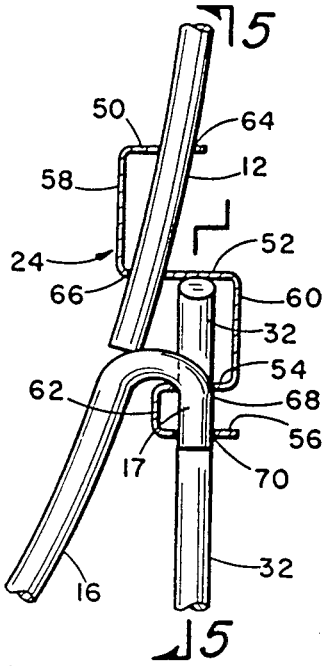
FIG. 4 ilustrates one of the clamping means clamping the ring and legs together and is a view taken along line 4—4 of FIG. 5.
Figure 5:
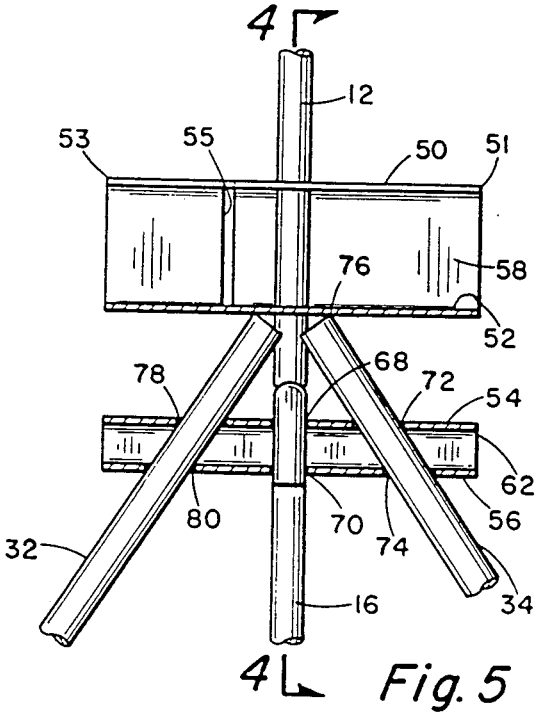
FIG. 5 is a view taken along the line 5—5 of FIG. 4.

Attention will now be directed to FIGS. 4 and 5 for a detailed description of the unique clamps 24 and 26 which are identical. Clamp 24 is comprised of one flat piece of metal rectangular in shape which has been bent at six right angles and drilled to form a clamp. The clamp material should be of a material which can be bent to the shape shown and have enough strength and rigidity to maintain its shape while in use. It includes four horizontal sections 50, 52, 54 and 56 and three vertical sections 58, 60 and 62. Section 52 is of a slightly greater width than 50, 52, 54 and 56 as shown in FIG. 4 and this width can be referred to as "A", "B", "C" and "D" respectively. By height I mean the vertical dimension of the sections 58, 60 and 62 also shown in FIG. 4 and the length can be referred to respectively as "E", "F" and "G". The crosssection of sections 50, 58 and 52 is U-shaped pattern as is the cross-section of sections 52, 60 and 54 and also sections 54, 60 and 56. The first and last mentioned U-shaped patterns face one direction and the middle one face the opposite direction. Sections 50 and 52 are provided with holes 64 and 66 which are slightly offset to permit the insertion of loop 12 of the ring of the pattern holder. Sections 54 and 56 are provided with center holes 68 and 70 respectively which are aligned and are for receiving hook 17 on the upper end of lower loop 16 of the ring pattern holder.

Sections 54 and 56 of the clamp 24 are provided with offset holes 72 and 74 so that the upper end 76 of leg 34 contacts section 52 near the center thereof. The left side of sections 54 and 56 are likewise provided with holes 78 and 80 which accommodate leg 32 in the same manner as that just described above for leg 34.

The assembly and disassembly of the device is very easy. To disassemble the device shown in FIGS. 1 and 2, I simply remove the lower ends of loops 12 and 14 from clamps 24 and 26 respectively and then remove the other ends from clamp 18. I then remove legs 30 and 34 from clamp 24 the other two legs from clamp 26. I also remove loop 16 from clamps 26 and 24. I then take all the disassembled parts and place them in a box or other suitable container. They can then be stored in the trunk of an automobile or any other suitable spot.

When it is desired to assemble the holder for the shotgun pattern paper, I remove the disassembled parts from their box or container. I first hook the hook ends of lower loop 16 through holes 68 and 70 of clamp 24 and similar holes in claim a 26, then I insert legs 32 and 34 through the respective holes indicated in FIG. 5 and legs 28 through similar holes in claim 26. I then have the lower part of the pattern holder assembled where it will rest upon the ground 15. I next fasten loops 12 and 14 together with clamp 18 and then insert the lower ends of these two sections through holes 64 and 66 of the clamp 24 and also corresponding holes through clamp 26. I am now ready to put the pattern paper 38 thereon. This is easily done by inserting the projections 37 through holes 40 and just let the paper hang thereon. A paper slit 55 can be cut in the clamp as shown in FIG. 5 to let the paper hand more evenly and eliminate two hooks. I am now ready for firing a shotgun at the target to obtain the shot pattern.

A clamping means 24 which I have built and found very satisfactory, had the following dimensions. The width of section 50 was ½", and section 56 was ½". The width of section 52 was ¾", section 54 was ½", section 58 was ¾", section 60 was ¾" and section 62 was ¼". These dimensions are along the lines of the section shown in FIG. 4. The length of a section as shown in FIG. 5 from point 51 to point 53 was about 2". Holes 64 and 66 for the top loop and holes 68 and 70 for the bottom loop were ¼". Holes 72, 74, 78 and 80 for the legs were 5/16" in diameter. This clamp is easy to make and holds all the inserted parts securely together.

Attention is now directed to FIGS. 6 through 10 which show a different embodiment of my portable paper pattern holder which includes a square frame instead of a circular frame as shown above in FIGS. 1 through 5. Attention is especially directed to FIG. 6 which shows a square holder comprising a top bar 82, a bottom bar 84 having hooked segments 84A and 84B, and side bars 86 and 88. The side bars 86 and 88 are fastened to top bar 82 respectively by clamps 90 and 92 which may be simple friction clamps so that when the ends of the bars are inserted therein, they are held in position until forceably removed. Paper holder 102, which may be similar to paper holders 36, are also provided at appropriate spacings about the square holder.

Figure 8:
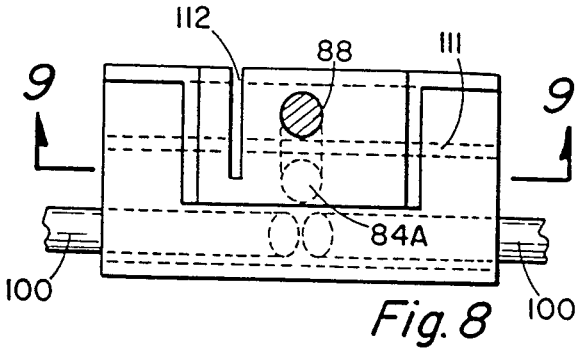
FIG. 8 is a view taken along the line 8—8 of FIG. 7.
Figure 9:
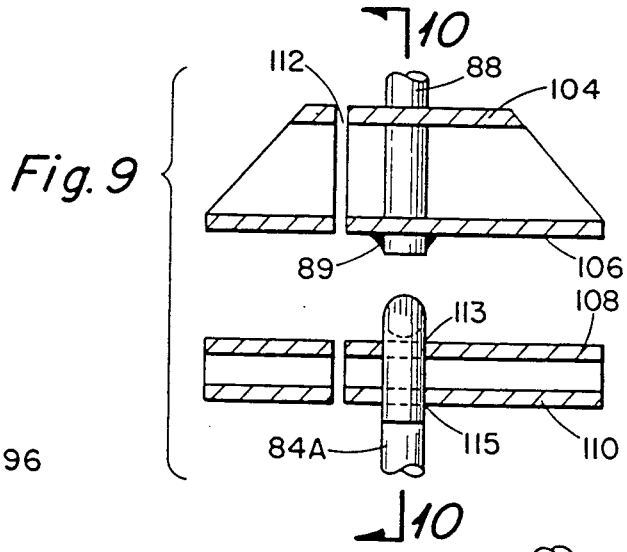
FIG. 9 is a view taken along the line 9—9 of FIG. 8.
Figure 10:
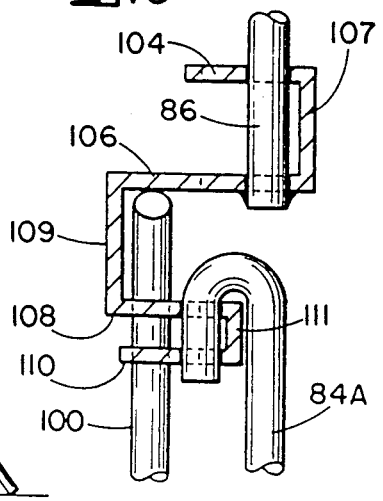
FIG. 10 is a view taken along the line 10—10 of FIG. 9.

Clamps 94 and 96 are essentially identical and are shown more clearly in FIGS. 8, 9 and 10. These clamps 94 and 96 are also similar to clamps 24 and 26 of FIGS. 1 to 5. The side bar or member 88 goes through upper section 104 and intermediate section 106 and is welded thereto at 89 as shown in FIG. 9. It is preferred that the side bars 88 be welded to the clamps 94 and 96, however, they can just be inserted as indicated above for the embodiment of FIGS. 1 through 5. Upright segment 84A of lower bar 84 hooks over and into holes 113 and 115 of sections 108 and 110 respectively as also shown in Figure 9. Support legs 100 and 101 extend upwardly through holes in plates 110 and 108 similarly as do support legs 32 and 34 extend upwardly through plates 56 and 54 as shown in FIG. 5. As shown in the embodiment of FIG. 4, holes 64 and 66 in members 50 and 52 are not vertically aligned because of the arc of the upper segment. However, in the clamp of FIGS. 6 through 10, the holes 109 and 111 are vertically aligned. As clearly shown in FIGS. 8 and 9, there is a paper slot 112.

Section 104 of the clamp is connected to Section 106 by vertical section 107. Likewise, horizontal section 106 is connected to horizontal section 108 by vertical section 109 and horizontal section 108 is connected to horizontal section 110 by vertical section 111.

Figure 16:
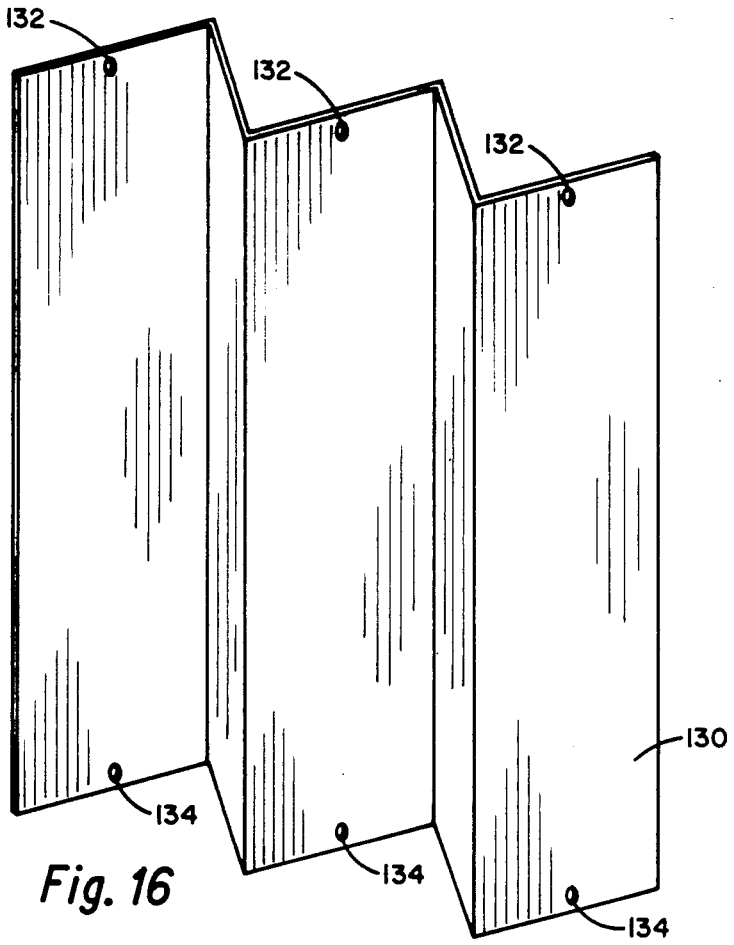
FIG. 16 is a folded board for use with the frame illustrated in FIGS. 6, 11 and 13.

Attention is now directed to FIGS. 13 through 19 which show a still further embodiment of my invention. The holder, as shown in these Figures, is quite similar to that of FIG. 6 except that the embodiment herein is especially suitable for calibrating rifle shot. Although it can be used for other type shooting or possibly target practicing with any type hunting device. Here we have a target base 130 which has a plurality of holes 132 at the top and a plurality of holes 134 at the bottom. These are looped over hooks 126 at the top and 128 at the bottom. Target base 130 is shown in FIG. 16 and is preferably made of cardboard and may be folded as indicated. Typically, the target base 130 is about forty inches by forty inches and has four folds which divides the base into five sections approximately eight inches wide. This can be folded into a form which is forty inches long and eight inches wide which can be stored or transported very readily. The target base 130 may have enscribed thereon a target having a series of concentric rings 131 with a bullseye 133 which is the center of a critical area which receives most of the bullet holes.

Figure 6:
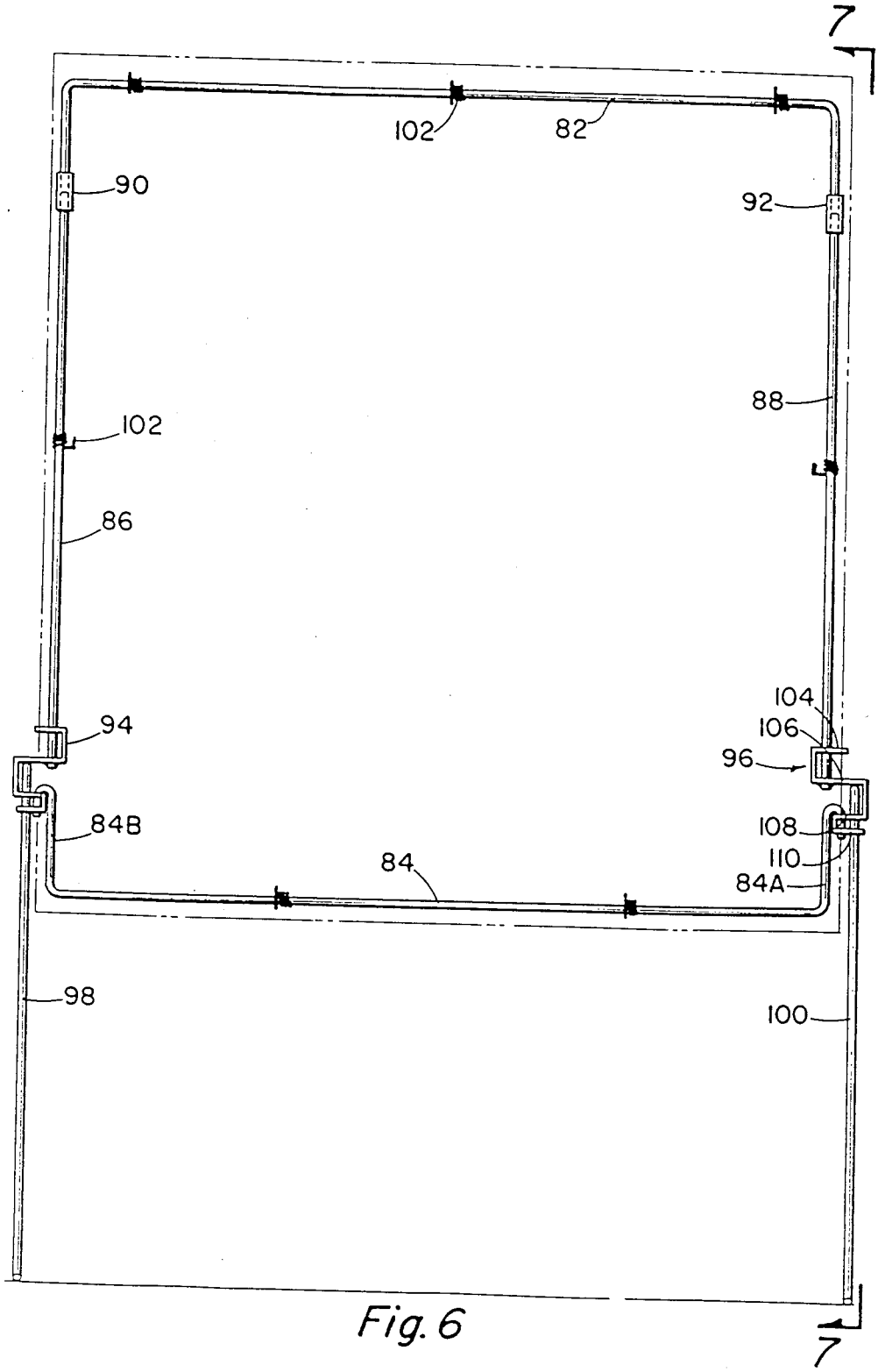
FIG. 6 shows a front view of another embodiment of my assembled holder for shotgun pattern paper.
Figure 7:
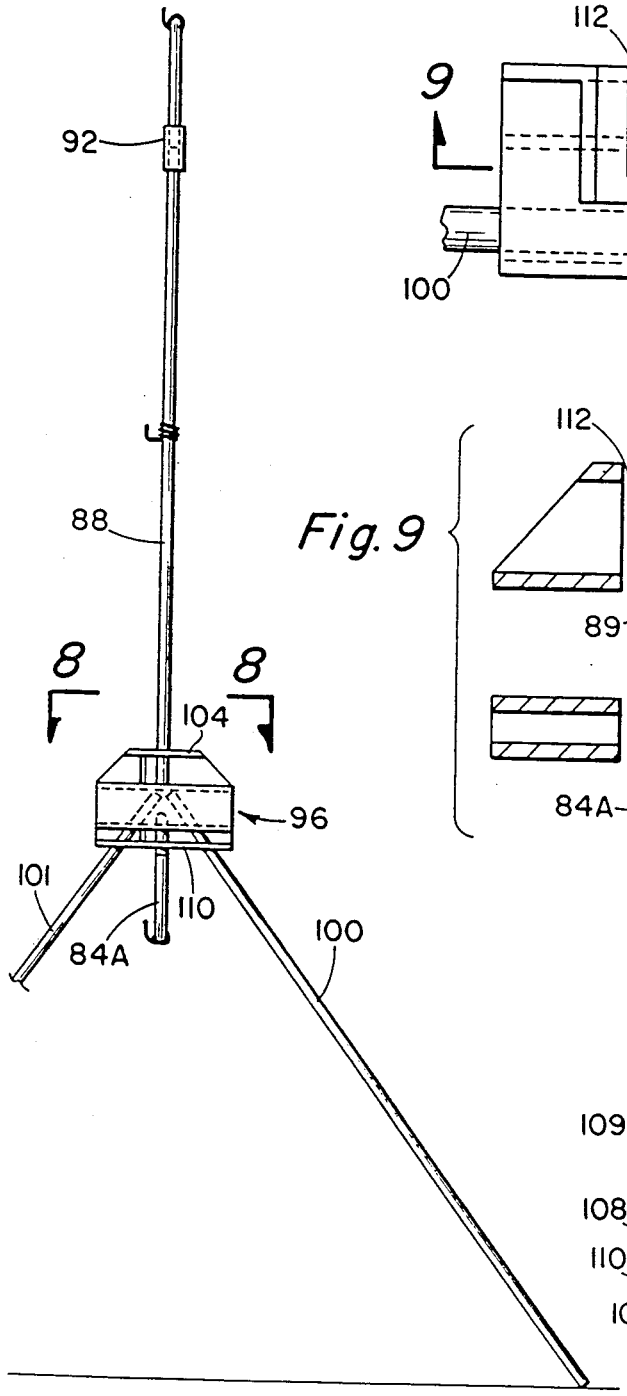
FIG. 7 is a view taken along the line 7—7 of FIG. 6.
Figure 13:
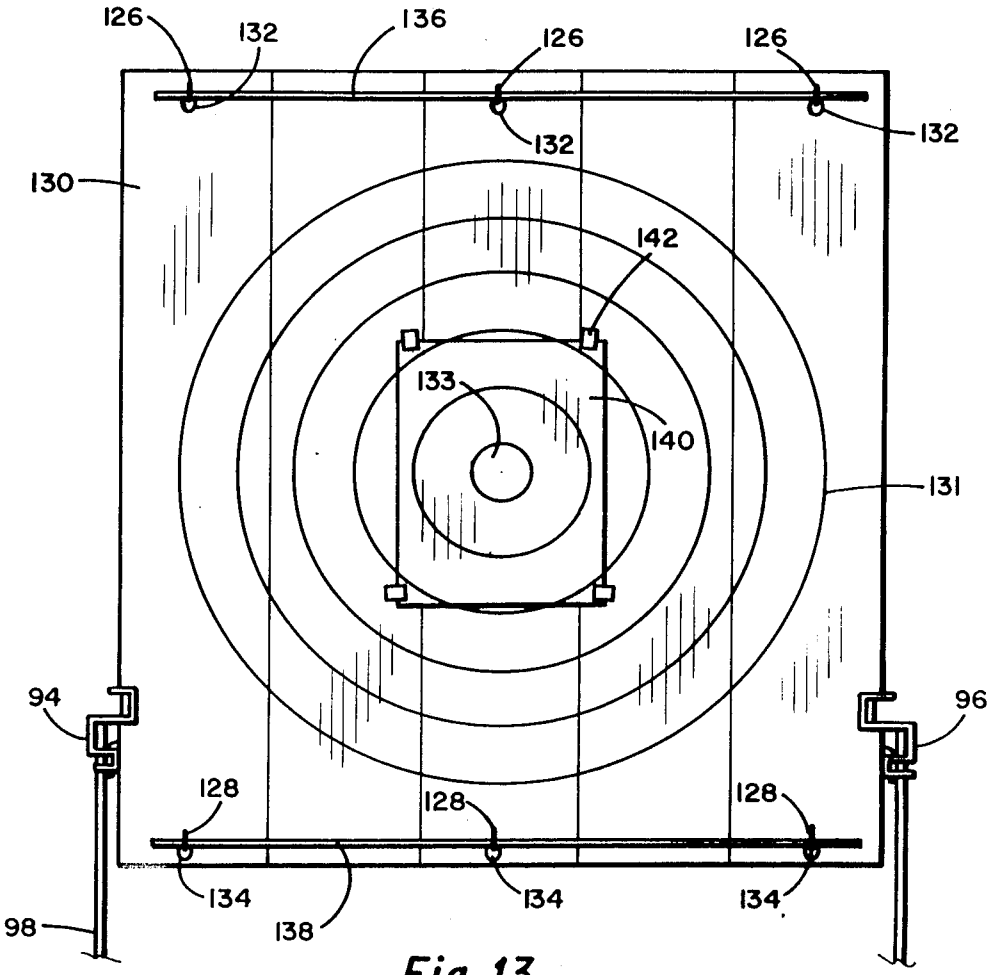
FIG. 13 is similar to FIG. 11 except it has a bullseye pattern thereon.
Figure 15:
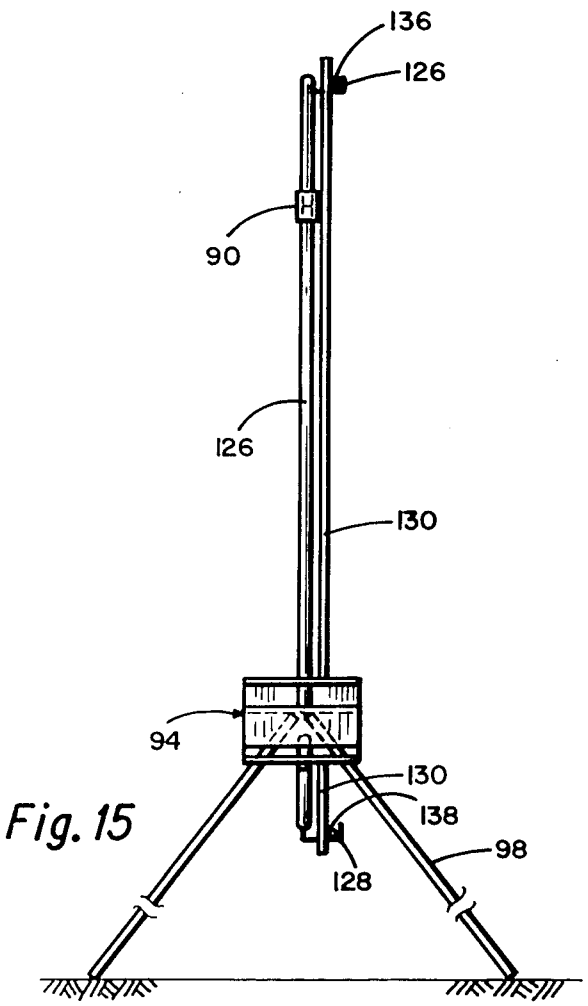
FIG. 15 is an end view of the embodiment of FIG. 13.
Figure 17:
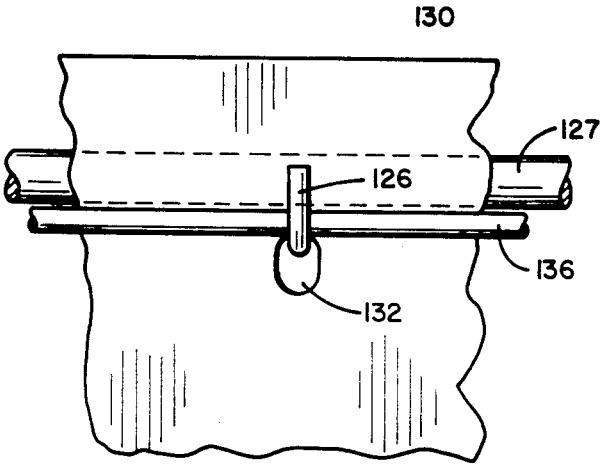
FIG. 17 illustrates the manner of suspending the board shown in FIG. 16.
Figure 18:
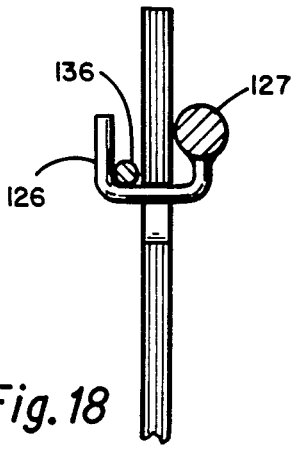
FIG. 18 is an end view of the view of FIG. 17.
Figure 19:
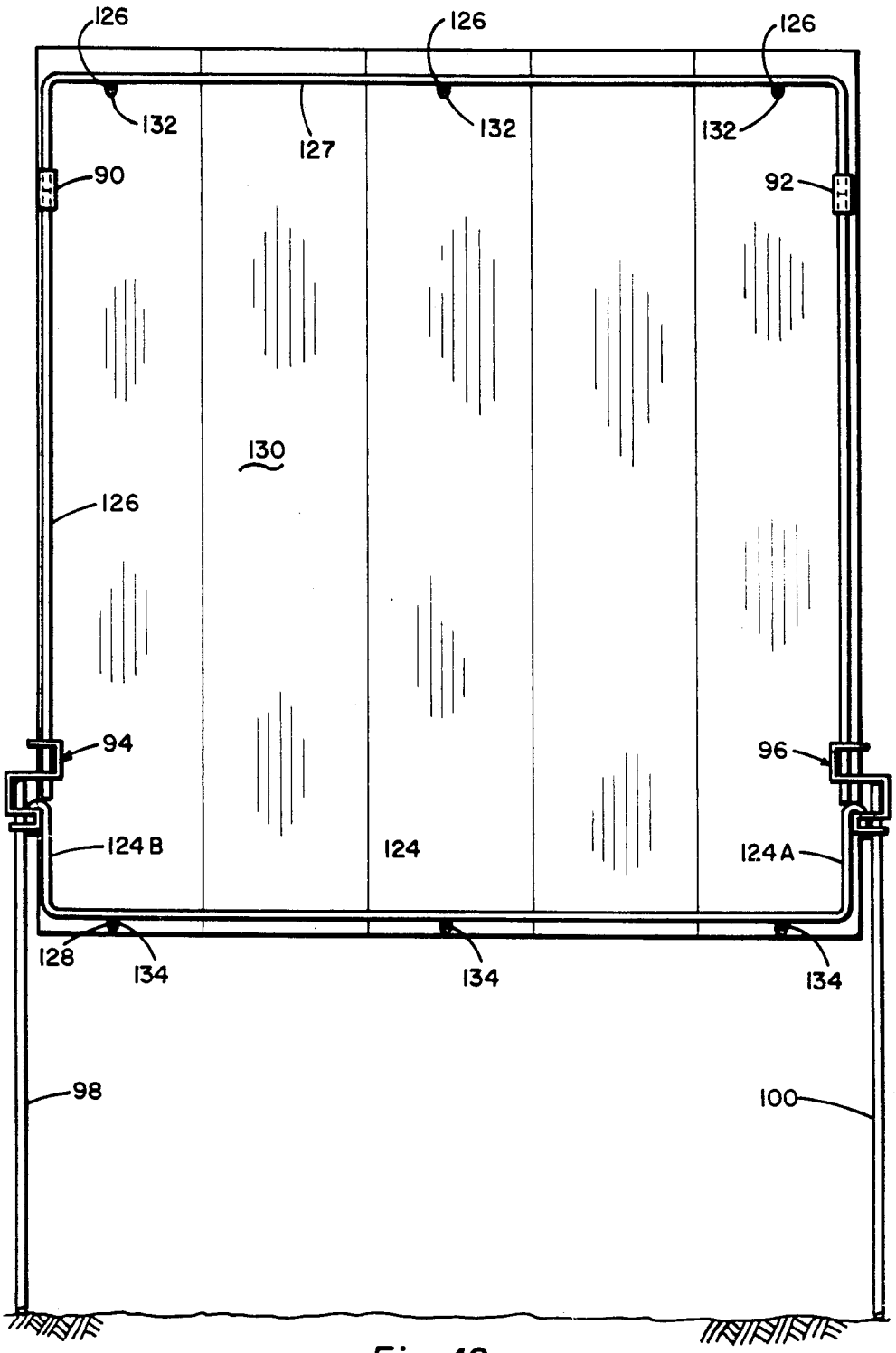
FIG. 19 is a back view of the embodiments of FIGS. 11 and 13.

Attention is now directed to FIG. 19 which shows the back side of the embodiment of FIG. 13 and shows the arrangement of the frame which is very similar to that of FIG. 6. Clamps 94 and 96 are identical to the clamps 94 and 96 of FIG. 6. Legs 98, 100 and upper clamps 90 and 92 are likewise identical to the legs and upper clamps of FIG. 6 having the same reference numbers. Top bar 127 is quite similar to top bar 84 of FIG. 6 except that it has a different means of holding the cardboard. This is illustrated in FIGS. 17 and 18 which shows locking bar 136 placed between the upward extension of hook 126 and the target base 130. This has been found to be a very effective way of holding the target base 130 in position. Bottom bar 124 is very similar to bottom bar 84 of FIG. 6, but it too has the upturning hooks 128.

The bullseye target on the target base 130 of FIG. 13 is very suitable for calibrating rifles or for simple target practicing. If the rifleman is a reasonably good marksman, most of the shot holes from the bullets will be within the bullseye 133 area or within one or two larger concentric rings. After a certain number of shots the target base 130 will have numerous holes in a critical area about the bullseye 130. These holes make it difficult to determine which hole was caused by the last fired shot. This is easily remedied. I merely take the target section of FIG. 14 and with tabs 142 I place it over the exact center of the target base 130. There is then a clean target area in the center of the target base. This permits continued rifle calibration or practice without having to replace the target base 130. This is a very economical concept and saves time for the person using the target.

Figure 11:
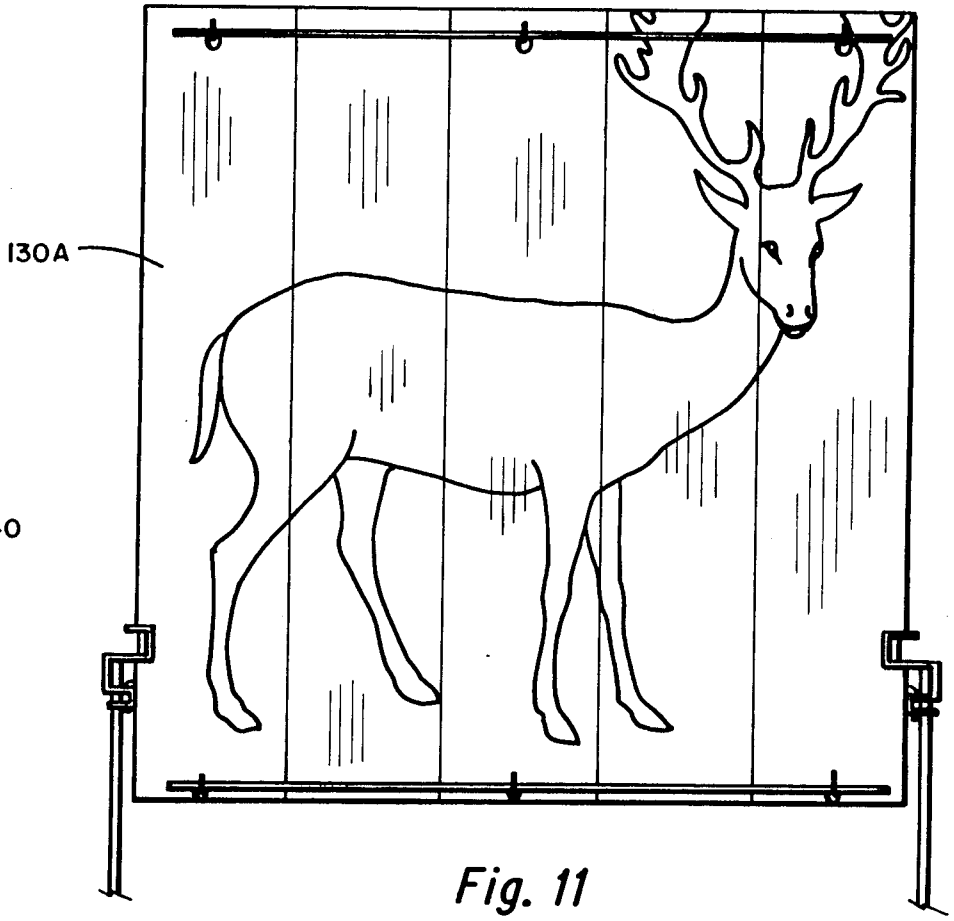
FIG. 11 shows a front view of still another embodiment of my assembled holder for determining gunfire accuracy.
Figure 12:
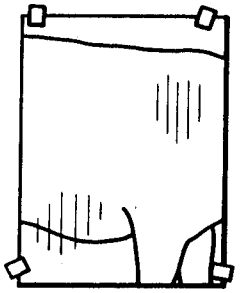
FIG. 12 illustrates a section of the FIG. 11.
Figure 14:
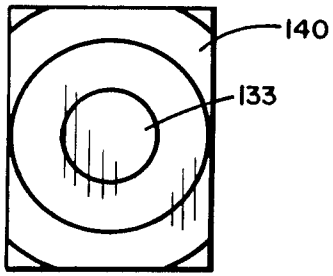
FIG. 14 is an insert section showing the bullseye of the configuration of FIG. 13.

FIG. 11 is quite similar to FIG. 13 except that a deer has been depicted thereon. FIG. 12 is similar to FIG. 14 but illustrates another target section which shows a critical area of the target base of FIG. 11 and can be used with FIG. 11 similar as FIG. 14 which was described as being usable with FIG. 13.

While the invention has been described with a certain degree of particularity, it is manifest that many changes may be made in the details of construction and the arrangement of components without departing from the spirit and scope of this disclosure. For example, the lower ends of loops 12 and 14 can be welded to clamps 24 and 26. It is understood that the invention is not limited to the embodiments set forth herein for purposes of exemplification, but is to be limited only by the scope of the attached claim or claims, including the full range of equivalency to which each element thereof is entitled.

What is claimed:

1. A holder for pattern paper comprising:

a rectangular frame including an upper bar, a first side bar and a second side bar, a bottom section with a hook member at each end thereof;

a first and second screwless clamping means to clamp said upper bar to said side base respectively;

leg means;

two bottom unitary clamp means each for receiving the lower end of one of said two side bars and for also receiving the hook member on one of said bottom section, said bottom clamp means each having two axially aligned holes laterally offset from the side bar's longitudinal axes for receiving saidleg means such that said leg means are not aligned with said side bar;

hooks extending from said upper bar and said bottom section;

a rectangular target base having holes therein matching the hooks on said upper bar and said bottom section so that the target base can be secured to the holder.

2. A holder as defined in claim 1 including a first holding rod placed over the hooks attached to said upper bar with said target base placed between said holding rod and said upper bar and a second holding rod placed over the hooks attached to the bottom section with said target base placed between said second holding rod and said bottom section.

3. A holder as defined in claim 2 in which said target base is provided with a target configuration thereon with a target critical area.

4. A holder as defined in claim 3 including a target section corresponding to said critical area and adapted to be placed over said target base to cover said target critical area.

5. A holder as defined in claim 4 in which said target base comprises a cardboard member which has a plurality of parallel equally spaced folding creases.

6. A holder as defined in claim 1 in which each said bottom clamp includes a flat piece of metal having a center line and which is bent at six lines perpendicular to said center line and in the form of right angles with succeeding right angles being reversed from the prior angles so that there are four parallel sections 1 (104), 2 (106), 3 (108) and 4 (110) in which section 2 is of greater width measured along said center line than sections 1, 3 and 4, there are aligned holes through sections 3 and 4 in the center line thereof, one hole on either side of the center line of section 3 and one hole on each side of the center line of section 4, the holes in section 4 being further from the center than those in section 3, and the hole in the center line of section 1 and section 2.

* * * * *